United States Patent [19]

Reusser

[11] 4,306,631

[45] Dec. 22, 1981

[54] NOISE BARRIER WALL OR BUILDING PANEL AND MOUNTING ASSEMBLY

[75] Inventor: Hans E. Reusser, Westlake, Ohio

[73] Assignee: Republic Steel Corporation, Cleveland, Ohio

[21] Appl. No.: 206,183

[22] Filed: Nov. 12, 1980

[51] Int. Cl.[3] ..... E04H 17/00; G10K 11/00

[52] U.S. Cl. ..... 181/210; 181/284; 256/24; 256/73; 52/144

[58] Field of Search ..... 181/210, 284, 287; 244/114 B; 256/21, 24, 25, 73; 52/144, 145, 478, 521, 529, 531, 537–539

[56] References Cited

U.S. PATENT DOCUMENTS 3,276,333 10/1966 Blok ..... 256/24

3,303,622 2/1967 Minds, Jr. ..... 256/24

*Primary Examiner*—Donald A. Griffin

*Assistant Examiner*—Benjamin R. Fuller

*Attorney, Agent, or Firm*—Emory L. Groff, Jr.

[57] ABSTRACT

A noise barrier or other type wall or building assembly includes a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

17 Claims, 5 Drawing Figures

NOISE BARRIER WALL OR BUILDING PANEL AND MOUNTING ASSEMBLY

This invention relates generally to panel assemblies and more particularly to a noise-screening assembly especially adapted to serve as a noise barrier between major highways or other noise-generating areas, and adjacent residential or other occupied dwellings. The construction may be readily applied to a building enclosure utilizing formed panels.

Broadly speaking, this invention may serve as a barrier to contain or isolate any noise-generating area such as airports and construction sites although presently the trend toward constructing residential areas in close proximity to interstate roadways has generated a substantial demand for economical, readily erected barrier walls comprising components of minimum weight and complexity yet which when assembled yield an installation having an acceptable eye appeal and sufficient resistance against wind loads.

Many prior known assemblies contain one or more objectionable characteristics. Some earlier devices require the application of numerous fasteners to rigidly interlock the mating edges of all of the adjacent panels due to the lack of inherent two-way or multilateral interlocking configuration between the panels. Other systems employ unusually heavy horizontal rails or girts to which the panels are attached, thereby unnecessarily adding to the cost of the assemblies in material, fabrication and difficulty of erection. With the present invention, a thinner new girt of properly rigidized form eases the attachment of a cap trim with drilling screws, and is more easily pre-punched for post attachment and panel bolting. Another shortcoming of certain earlier assemblies involves the exposure or ready accessibility of the fasteners utilized or the sharp edges of joined sheets, thereby readily increasing the likelihood of vandalism while also increasing the potential for injury and additionally detracting from the eye appeal of the installation.

By the present invention, an improved noise barrier assembly is provided yielding a high wind load capacity by means of an improved panel configuration, supporting girts and interlocking elements integrally formed along both lateral edges of the panels such that a rigid, positive multilateral interlock is achieved between the adjacently installed panels. The installation of the panels with respect to fixedly disposed girts is achieved by progressively bolting or otherwise attaching the panels to the girts from one end thereof to the other in a sequence that includes tilting or rotating one panel edge interlock element of each panel with respect to a mating panel edge interlock element of a previously attached panel, and continuing this process until the entire span of each set of spaced apart girts is covered by the panels.

The plurality of panels spanning a set of girts are each contoured to provide an improved shadow texture on both faces as well as a narrow and deep recess in the interlocking area juxtaposed the mating areas of adjacent panels. The interlocked lateral edges of each pair of adjacent panels contain but a single fastener through the interlocked flanges and the adjacent intersecting girts thereby resulting in not only a minimum number of fasteners to complete the assembly of each span but also providing a substantial masking or inaccessibility of the associated fastener elements.

The running length of the present barrier wall assembly comprises a plurality of the above described spans each including a top and bottom girt having their ends respectively affixed to a pair of structural posts, such as H-beams suitably anchored within the ground. Intermediate rectangular girts and covers that project inward from their post mountings may be added to support relatively tall panels against extremely heavy wind loads. It will be understood that the two or three girts of succeeding spans are affixed to opposite sides of the intermediate support posts such that a staggered succession of the spans is achieved. With the arrangement of the present construction, it will be seen that this assembly not only facilitates the erection of the barrier wall but also improves resistance against wind loads, increases eye appeal through staggering and variation of the shadow texture between adjacent spans due to the reversal of the panel contour in each span and additionally, allows variation in the height of adjacent spans to accommodate variations in terrain contour.

Accordingly, one of the objects of the present invention is to provide an improved noise barrier wall assembly comprising a plurality of spans each including a plurality of contoured panels attached to horizontal girts in turn affixed to supporting posts, with succeeding spans alternately affixed to opposite sides of the supporting posts.

Another object of the present invention is to provide an improved noise barrier wall assembly including a plurality of spans affixed to intermediate support posts with each span including at least a pair of parallel girts to which are attached a plurality of contoured panels each having lateral edges configured alternately, to form male and female elements which when progressively mated yield a rigid interlocking of the plurality of panels both in a lateral and transverse direction.

A further object of the present invention is to provide an improved noise barrier wall assembly including a plurality of spans each having a plurality of adjacently interlocked panels each contoured to provide a centrally disposed depression extending transversely substantially one-half the depth of the panel and having opposite side walls spaced from adjacent interlocked panels to provide a narrow recess extending substantially the full depth of the panels.

Still another object of the present invention is to provide an improved noise barrier wall assembly including a plurality of spans attached to intermediate vertical support posts with each span having at least a top and bottom convoluted girt between which a plurality of contoured interlocked panels are mounted by means of fasteners disposed therethrough with a cap trim overlying the top girt and masking the panel fasteners secured thereto.

Another object of the present invention is to provide an improved noise barrier wall assembly including a plurality of spans alternately affixed to opposite sides of intermediate support posts together with a pair of cover panels mounted about each support post to completely mask all sides thereof.

Still another object of the present invention is to provide an improved noise barrier wall assembly including a plurality of spans alternately affixed to opposite sides of intermediate support posts with alternate ones of the spans containing a plurality of interlocked contoured panels mounted in the respective spans with their obverse and reverse faces exposed with neither aspect of exposure providing access to cut sheet edges that might result in injury.

An added object of the present invention is to utilize for building exterior walls the inherent advantages and improvements in a panel form, joint interlock and mounting ease as described for a noise barrier wall with the exception that the panels are normally mounted all facing outward regardless of wall extent, on any building side.

With these and other objects in view which will more readily appear as the nature of the invention is better understood, the present invention consists in the novel construction, combination and arrangement of parts hereinafter more fully described, illustrated and claimed.

Similar reference characters designate corresponding parts throughout the several figures of the drawings.

Figure 1:
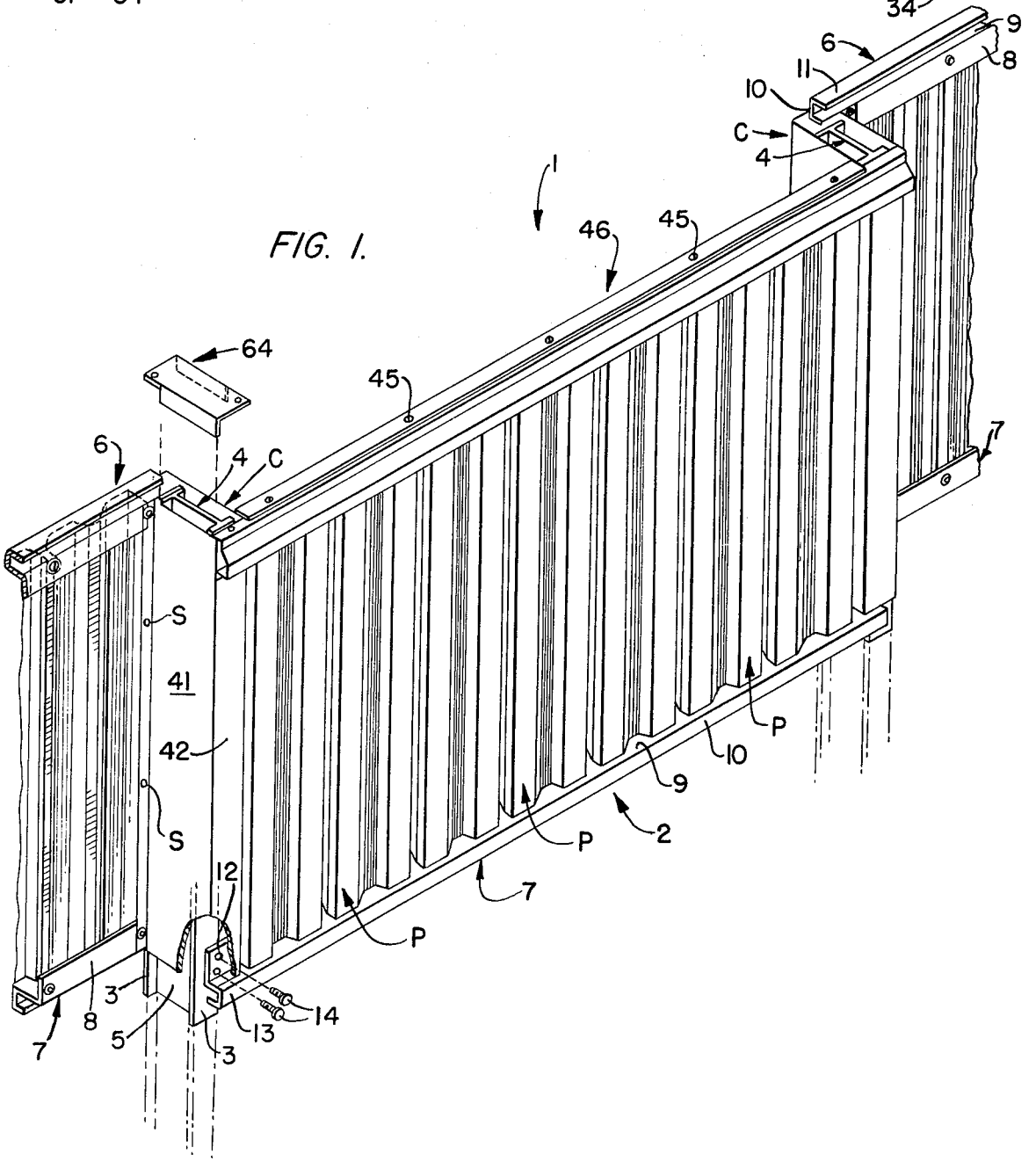
FIG. 1 is an elevated, fragmentary perspective view of a noise barrier wall assembly according to the present invention with partial omission of post caps and girt cap trim portions for clarity.

Referring now to the drawings, particularly FIG. 1, the present invention will be seen to comprise a noise barrier wall assembly, generally designated 1, including a plurality of adjacently disposed spans 2 with each succeeding span supported upon opposite faces or flanges 3 of the intermediate vertical support posts 4. Each support post may comprise any suitable structural member such as the illustrated H-beams having the central web 5 joining the oppositely disposed flanges 3—3. The support posts 4 are vertically positioned with their lower portions adequately secured within the underlying ground and each pair thereof are preferably equi-spaced from one another such that a constant length span is achieved between each pair of posts in the overall assembly. This arrangement allows for ease of erection by requiring only one size of mounting components yet it will be appreciated that the present invention readily lends itself to the provision of various lengths of spans 2 without departing from the spirit of the invention.

A description of the construction of one span 2 will serve to provide an understanding of the individual components forming an entire noise barrier wall assembly 1 since identical components and method of assembly are utilized in each span. Following installation of the spaced apart support posts 4, a top girt 6 and bottom girt 7 are respectfully affixed to the upper and lower portion of two spaced apart posts 4. It will be understood that the bottom girt 7 will be disposed at or close to grade level and to insure that the two girts 6 and 7 are horizontal and parallel to one another it may be necessary to cut a nominal amount of soil due to variation in the ground contour beneath any span 2. Likewise it will be appreciated that generally a nominal amount of backfill will be required to close sound leakage gaps under the bottom girts following complete installation.

Figure 4:
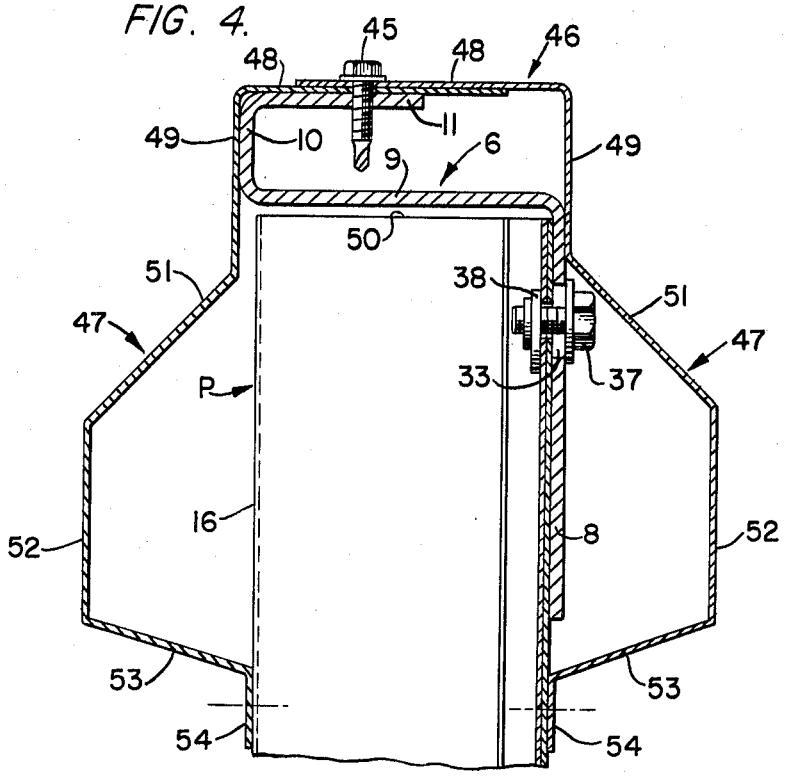
FIG. 4 is a vertical sectional view located above the line 4—4 of FIG. 3 through the top girt and cap trim assembly.

The two girts 6 and 7 are preferably of identical construction and each comprises a convoluted rail or beam, the configuration of which is shown most clearly in FIG. 4 of the drawings. With the illustrated convoluted construction it will be appreciated that sufficient strength for mounting and supporting each span to the two opposite support posts 4 will be readily achieved by utilization of a minimum gauge material and the disclosed girt construction is furthermore most desirable since the same configured girt is used for both the top girt 6 and bottom girt 7 merely by reversing the member. Accordingly, it will be appreciated that each girt includes a vertical post and panel mounting flange 8 joined to the horizontal wall 9 and which in turn is joined to a raised section 10. This latter raised section 10 terminates in a reversely extending spaced wall 11 which will be seen to overlie the horizontal wall 9 yet is substantially shorter than the horizontal wall. For reasons which will become obvious hereinafter, the horizontal wall 9 extends outwardly from the mounting flange 8 a distance which is no less than the overall depth of the panels P as clearly shown in FIG. 4.

Figure 3:
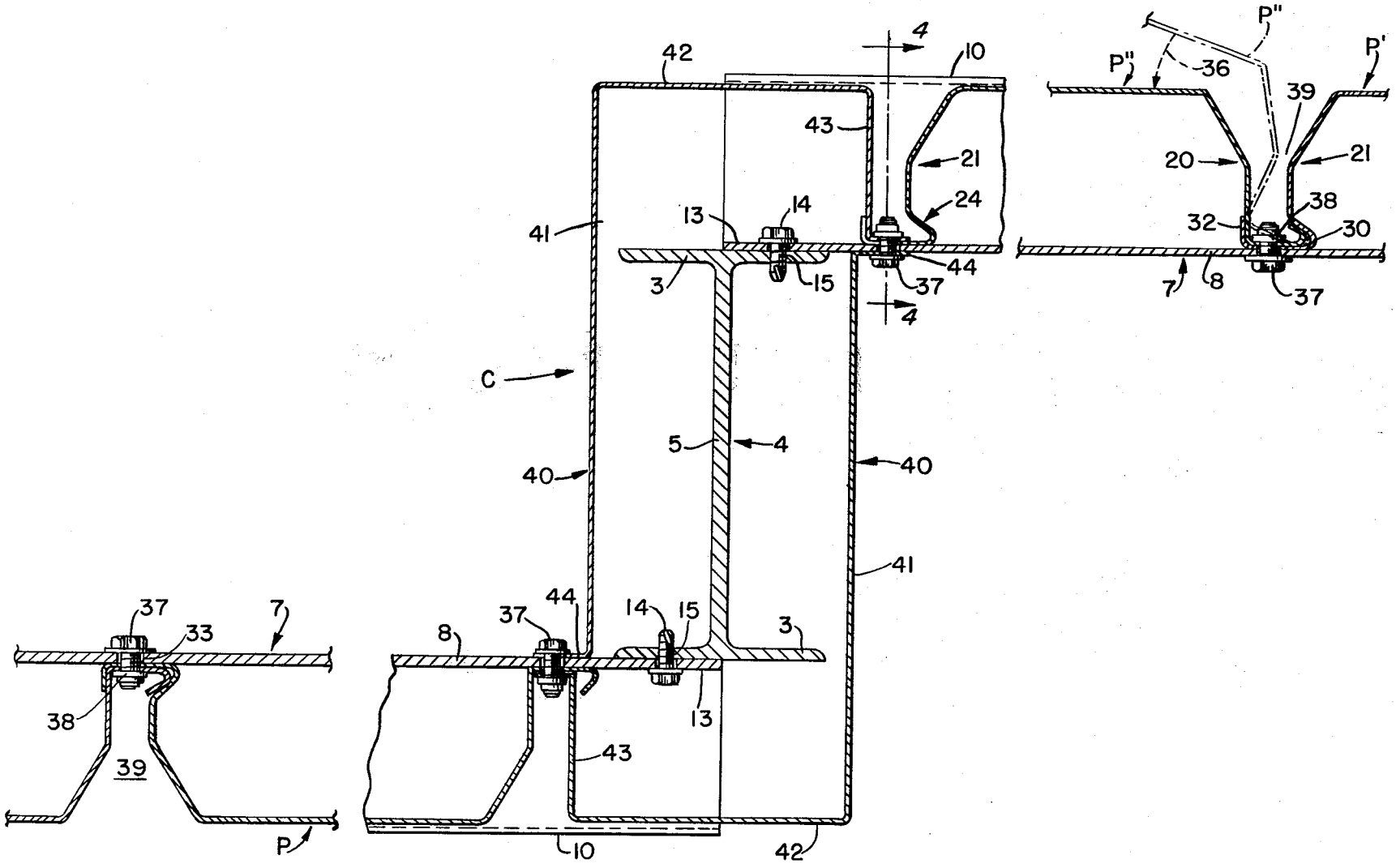
FIG. 3 is a partial horizontal sectional view taken through a supporting post and bottom fasteners intermediate two spans.

Each end of all the girts 6–7 are preferably prepunched with a pair of holes 12—12 as shown in FIG. 1 of the drawings and which are intended to be disposed in overlying engagement with a portion of the flange 3 of the respective supports posts 4. The support posts are spaced such that the ends 13 of the girts will overlie only one-half of the post flanges as shown in FIG. 3 of the drawings and after alignment of the top and bottom girts with respect to the post flanges and panel attachment, holes 15 are field-drilled through the post flanges at the girt end holes to allow attachment by means of self-tapping screws 14. Quite obviously, the support posts could not be pre-drilled since the exact hole spacing required to match the girt holes would be too difficult to certify in the placement of posts.

Following attachment of the top and bottom girts 6–7 to a pair of spaced apart support posts 4, the noise screening panels P are installed. The configuration of each contoured panel P will be most readily apparent from a review of FIG. 2 of the drawings, wherein it will be seen that each panel includes a pair of planar sections 16—16 between which is disposed an intermediate cavity or dished portion 17 formed by a pair of angled side sections 18—18 joined by a planar bottom section 19. The outer portion of each planar section 16 communicates with a first side wall 20 and second side wall 21, respectively. Each side wall includes an angular section 22 communicating with the adjacent planar section 16 and which extends to a point substantially intermediate the overall height or depth of the panel. It should also be noted that the above described intermediate cavity 17 likewise extends inwardly to a point such that its bottom section 19 is disposed substantially medially of the overall depth of the panel.

Figure 2:
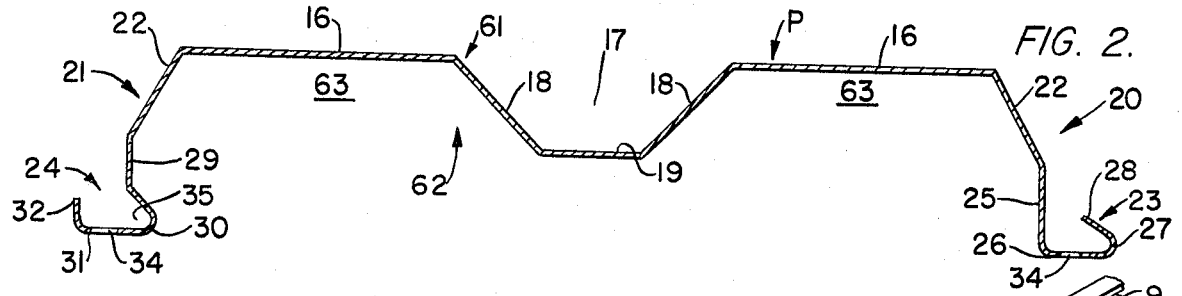
FIG. 2 is a horizontal sectional view of one of the panels.

From the angular sections 22—22 of the two panel side walls 20–21 the otherwise symmetrical configuration of the panel deviates. The balance of the lateral flange of the first side wall 20 is constructed to provide a male interlock element 23 while the balance of the lateral flange of the second side wall 21 is configured to provide a female interlock element 24. The male interlock element 23 includes a vertical wall 25 extending from the angular section 22 to a planar base mounting section 26 which will be seen to be joined to an outwardly directed nose 27 in turn terminating in the angular return flange 28. The female interlock element 24 associated with the opposite or second side wall 21 includes a vertical wall 29 extending from the adjacent angular section 22 to a point well short of an extension of the plane of the base mounting section 26 of the male interlock element 23 at which point it is connected to an inwardly directed nose 30 joined in turn to a planar base mounting section 31. This base mounting section 31 terminates with the vertically disposed flange 32. From the panel as depicted in FIG. 2, it will be seen that the lower and upper surfaces of the two base mounting sections 26,31 respectively, are in a common plane perpendicular to the plane of the vertical walls 25,29 and vertical flange 32 as applied in FIG. 3.

With the above construction in mind, the manner of attachment of the plurality of panels within each span 2 will be most readily understood from a review of FIG. 3 of the drawings. Both the top and bottom girts 6–7 will have been pre-punched to provide a single hole 33 intended to cooperate with a single hole 34 provided in each panel interlock element 23 and 24 adjacent both ends thereof. Thus, it will be seen that following installation of adjacent pairs of panels within each span, bolt fasteners will be applied to retain the interlocked panels at both the top and bottom girts.

This interlocking of the panels P is achieved by proceeding either from right-to-left or left-to-right between any two spaced apart support posts 4—4. Initially a pair of panels P are interlocked before they are placed with a side wall 20 adjacent to a support post 4 and are then bolted to girts 6–7 only through the interlocked elements 23–24 between the panels. For the interlocking method and subsequent attaching means one may refer to FIG. 3 of the drawings and consider that panel P′ represents an already installed panel following which the adjacent panel P″ is to be installed. This installation is achieved by initially angularly inserting the male interlock element 23 of the panel P″ into the female interlock element 24 of the already installed panel P′ as reflected in the broken line portion of FIG. 3. This initial insertion involves urging the outwardly directed nose 27 of panel P″ into the cavity 35 formed by the inwardly directed nose 30 on panel P′ with the juncture between the base mounting section 26 and vertical wall 25 of panel P″ engaging the inner surface of the vertical flange 32 of the already installed panel P′. After this initial insertion, the panel P″ is tilted or rotated in the direction of the arrow 36 whereupon it will be understood that the resultant camming action between the cooperating interlock elements of the two panels forces the components into the full-line position shown in FIG. 3 thereby providing a positive and rigid interlocking action between the two adjacent panels which interlock resists both lateral as well as transverse relative displacement between the adjacent panels along their full extent between the girts.

When the panels are interlocked as above, a single bolt fastener 37 is disposed through the girt hole 33 and the overlying or aligned openings 34—34 of the two interlocked panels to attach the panels to each of the two girts and to also preclude any relative displacement between the panels in a vertical direction. The holes 33 pre-punched in the two girts 6–7 are preferably vertically elongated or slotted as shown with the top girt-to-panel bolt 37 in FIG. 4. This provision compensates for any inherent nominal distortion of the pre-punched girts as may occur during processing thereof such as during galvanizing of the girts. The panel bolt fastener 37 may be combined with any suitable nut such as the elongated tab type nut 38 and this type of fastener, in combination with the narrow recess 39 formed between the interlocked adjacent panels eliminates the need for a wrench to prevent nut rotation during tightening. If post covers C are installed during the sequence of panel installation instead of after, the first panel and cover are bolted on together before the next panel is interlocked.

Installation of individual panels P continues progressively from the first installed panel until all of the panels are affixed to the spaced apart girts as they are interlocked with one another throughout the horizontal extent of any one span 2. With proper means for hoisting and positioning, an entire wall section consisting of girts 6–7 and panels P may be pre-assembled with all bolts except through the non-engaged end panel flanges, and then installed on the posts 4 by drilling through the pre-punched girt end holes and fastening with the tapping screws 14. The terminal-most side walls of the first and last installed panels adjacent to a post are anchored to the spaced apart girts 6–7 in combination with the application of a unique cover assembly C provided to mask all four sides of each support post 4. This cover assembly C is shown most clearly in FIGS. 1 and 3 of the drawings and comprises first and second cover sections 40—40 preferably of identical construction with each section including a long wall 41 joined to a right angle end wall 42. From FIG. 3, it will be seen that the long wall 41 is of substantially greater extent than the length of the web 5 of the support post while the end wall 42 is of greater horizontal extent than each end flange 3 of the support post. Both the long wall 41 and return wall 43 terminate in an angular mounting flange 44 which is pre-punched adjacent its top and bottom portions to align with matching pre-punched holes 34,33 in the already installed panels and top and bottom girts. The cover assembly C is invertible for application in either a right hand or left hand post enclosure mode as needed.

The final attachment of the last installed panel P in any span along with the initial panel attachment in the next span, is achieved simultaneously with the attachment of the cover assembly C by the application of bolts 37 through the above mentioned aligned holes through the cover section mounting flanges, girts and panel base mounting sections 26 or 31. Since there is no interlocking at the juncture of the panel base and the post cover mounting flanges, these parts are tightened together as indicated in FIG. 1 with self-drill stitch screws S widely dispersed between the grit connections and having their points harmlessly recessed between the post cover and panel.

As previously mentioned, the two girts 6–7 are preferably identically configured. The same convoluted girt 6 shown in FIG. 4 is used as a bottom girt 7 merely by reversing and inverting the member whereupon the horizontal wall 9 becomes a shelf as shown in FIG. 1 and upon which the panels are disposed during installation. Long panels in unusually high walls may require a center girt of different configuration for added support against buckling during high winds. The provisions for a center girt include additional panel bolting and post attachment, notching of post covers for clearance, and a girt trim cover. Center girt form will be dictated by such provisions as well as structural requirements.

Following next is the final element of the main assembly, namely the cap trim, generally designated 46. This cap trim 46, shown installed in the center-most span 2 of FIG. 1, is most clearly illustrated in detail in the enlarged view of FIG. 4 of the drawings and will be seen to comprise a pair of identical trim half sections 47—47 each including a top wall 48 of slightly lesser extent than the overall depth of the underlying top girt 6 and which is joined to a vertical wall 49 extending downwardly to a point below the underlying panel top 50. Each trim half section 47 then proceeds with an outwardly sloping wall 51 terminating in a downwardly extending side wall 52 which in turn is joined to an inwardly angled wall 53. The trim sections terminate in a downwardly extending bottom flange 54 which is disposed in a vertical plane slightly inwardly from that of the uppermost vertical wall 49 for reasons which will become apparent from a close review of the finally installed position shown in FIG. 4 of the drawings.

The two trim half sections 47—47 when positioned as illustrated are secured by means of appropriate drill screws 45 driven through the two overlapping top walls 48 and into the top girt spaced wall 11 thereby retaining the two sectioned cap trim 46 in position. By providing bottom flanges 54 of the two cap half sections in a plane disposed inwardly of the plane of the raised sections 10, it will be appreciated that a flush engagement is assured between these flanges and the panel base mounting sections 26 of the interlocked panels on the one hand and the planar sections 16 of the panels on the other hand. Such an offset arrangement is necessary in view of the thickness presented by the girt mounting flange 8 which is present at the uppermost portion of the panel assembly but is non-existent in the area of the trim bottom flange 54. Since there is no girt mounting flange 8 on the opposite side of the assembly as illustrated in FIG. 4, it will follow that the same flush engagement between the bottom flange 54 of the other trim half section 47 is assured in view of the offset disposition of the girt raised section 10 with respect to the underlying panel planar section 16. Thus, it follows that the two identical trim half sections 47, with differing lengths, avoid complications in forming, end notching and low shipping density associated with a one piece cap trim that would not improve appearance. The cap trim hides the top girt 6 along with panel bolts 37 and extends the full inner and outer face length of wall span 2, including post cover end walls 42.

A post cap 64 of right or left hand downward flange form is fastened with drill screws to the girt top ends to close a gap above the post covers flush with the girt tops and cap trim 46 as shown in FIG. 1.

Figure 5:
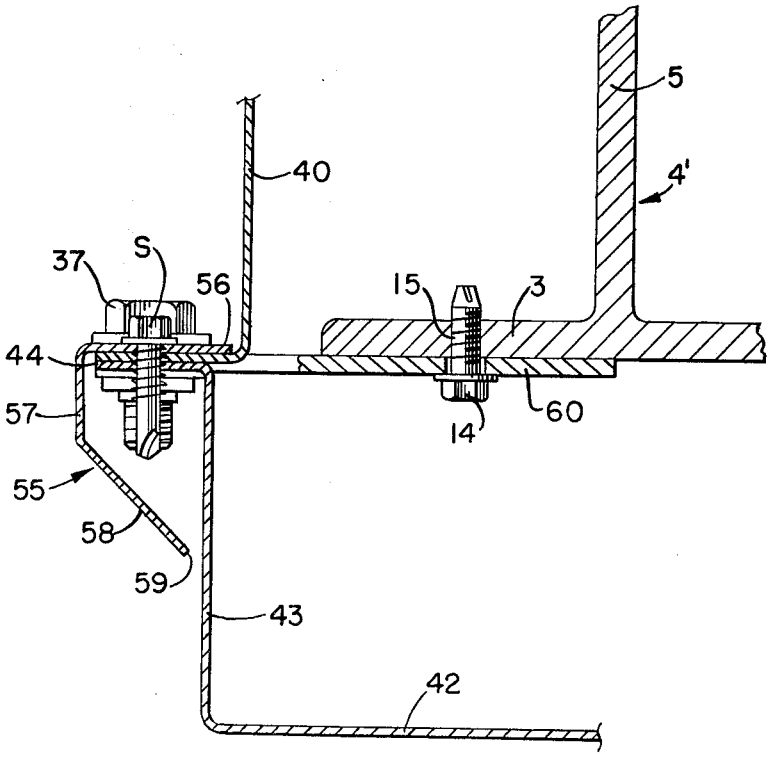
FIG. 5 is a fragmentary horizontal section view illustrating the attachment of the post cover panels at an end-most supporting post of a wall installation.

FIG. 5 illustrates an arrangement for applying the intermediate post cover assembly C to an end post 4′ located at the very beginning and end of a noise barrier wall assembly according to the present invention. So that the same type cover sections 40—40 may be utilized without requiring modification for this situation, the otherwise exposed sharp edges of cover flanges 44 and drill points of stitch screws S are enclosed by a cover batten 55 including a mounting flange 56 penetrated by the screws and a side wall 57 which terminates in an angular end wall 58 having its distal portions 59 juxtaposed the adjacent cover section return wall 43. Inasmuch as there is no girt 6 or 7 extending to the left of the end-most post 4′ shown in FIG. 5, which girts would normally serve as the support means for cover attachment by means of bolts 37, substitute elements in the form of the post cover bracket 60 are attached at the normal top and bottom girt locations on the post flange 3 with normal self-tapping screws 14.

Returning to the contour of the panels P as shown in FIG. 2 and the installation of these panels in the three spans reflected in FIG. 1, it will be noted that an alternate disposition of the interlocked panels occurs between succeeding spans. The panel P may be considered to have an obverse or outer face 61 on the one hand and a reverse or inner face 62 on the other hand. With the attachment of the top and bottom girts 6–7 to opposite end flanges 3 of the intermediate support posts 4, it will follow that the panels will in turn be affixed to the respective girts on alternating sides of the intermediate support posts and thus each span 2 will exhibit alternately, obverse 61 and reverse 62 faces of their respective panels to a viewer on either side of the noise barrier wall assembly 1. In either case, a desirable shadow texture and improved noise blanking is achieved in view of the contoured effect produced by the alternate dished configuration which when viewed from the obverse face 61 includes the shallow intermediate dished portion 17 as well as the narrow, deep dished portions 39 presented in the areas adjacent the mating interlock elements and when viewed from the reverse face 62 includes the two large deeply dished portions 63—63 disposed on either side of the shallow raised area of the reverse portion of the cavity 17.

During the installation of the various spans of the overall assembly, all of the panels may be progressively interlocked while proceeding in the same direction or alternatively, panels of any one span may be assembled in either direction. This alternative direction of assembly may be achieved merely by inverting all of the panels for any one span, it being understood that the starting flange, or that flange first attached adjacent a supporting post, must be the male interlock element 23 of the panel.

I claim:

1. A noise barrier assembly including, a span having two spaced apart support posts having lower portions mounted within the ground, top and bottom girts extending between said posts and fixed thereto, a plurality of vertically disposed panels extending between said posts and between said girts, said panels provided with opposite side walls having cooperating mating interlock elements providing a multilateral interlock between adjacent panels following the sequential joining of said interlock elements of succeeding panels, means fastening the opposite ends of said interlocked panels to said top and bottom girts, and said fastening means engaging said joined interlock elements to secure same to said girts.

2. A noise barrier assembly according to claim 1 wherein, one said panel side wall includes a male interlock element and the other said panel side wall is provided with a mating female interlock element.

3. A noise barrier assembly according to claim 1 wherein, each said panel includes an obverse face, said side wall extending rearwardly from said obverse face to said interlock elements, opposed side walls of adjacent panels of said interlocked panels spaced from one another to provide a narrow recess extending substantially the full depth of said panels, said fastening means disposed in the bottom of said recesses whereby, said recesses provide a heavy shadow texture and screen said fasteners.

4. A noise barrier assembly according to claim 1 wherein, said support posts include oppositely facing mounting flanges, said top and bottom girts selectively fixable to either said mounting flanges, said panels provided with contoured obverse and reverse faces each yielding a different shadow texture whereby, fixation of said girts to alternate ones of said post mounting flanges and fastening of said panels to said girts exposes alternate said panel faces when viewed from any one side of a plurality of said spans.

5. A noise barrier assembly according to claim 1 including, a cap trim overlying said top girt and the upper portion of said panels.

6. A noise barrier assembly according to claim 1 including, a cover assembly surrounding all sides of said support posts and ends of said girts fixed thereto.

7. A noise barrier assembly according to claim 1 including, a plurality of said spans disposed in series with each adjacent pair of said spans separated by one said support post.

8. A noise barrier assembly according to claim 1 wherein, said two girts are of identical convoluted form with said top and bottom girts being reversed and inverted from one another.

9. A noise barrier assembly according to claim 1 wherein, said interlock elements extend throughout the vertical extent of said panel side walls to provide a continuous interlock between said panels throughout their height.

10. A noise barrier assembly according to claim 2 wherein, both said interlock elements include a base mounting section engageable with a mating one of said interlock elements of an adjacent panel, said female element base mounting section joined to an inwardly directed nose and overlying a portion of said girts, said male element base section joined to an outwardly directed nose whereby, said male element nose is insertable within said female element nose to sandwich said female element base mounting section between said male base mounting section and said girts.

11. A noise barrier assembly according to claim 5 wherein, said cap trim includes a pair of similar half sections having top walls overlying one another and said top grit.

12. A noise barrier assembly according to claim 6 wherein, said cover assembly includes a pair of similar half sections each having distal mounting flanges and fasteners securing said flanges together.

13. A noise barrier assembly according to claim 7 wherein, said support posts include oppositely facing mounting flanges, said top and bottom girts of alternate said spans fixed to opposite ones of said post mounting flanges, said panels provided with contoured obverse and reverse faces each yielding a different shadow texture whereby, fixation of said girts to alternate one of said post mounting flanges and fastening of said panels to said girts exposes alternate said panel faces when viewed from any one side of said assembly.

14. A noise barrier assembly according to claim 8 wherein, each said girt includes a vertical mounting flange fixable to said posts and joined to a horizontal wall juxtaposed a respective end of said panels, a raised section joined to a top wall spaced from said horizontal wall and the width of said horizontal wall is no less than the depth of said panels.

15. A noise barrier assembly according to claim 10 including, a vertical wall adjacent said male element base mounting section opposite said male element nose, a vertical flange adjacent said female element base mounting section opposite said female element nose whereby, angular insertion and subsequent rotation of said male element of one panel within said female element of another panel produces a camming action of said vertical wall against said vertical flange to urge said male element nose into said female element nose.

16. A noise barrier assembly according to claim 15 wherein, said angular insertion and rotation of said male element of one panel within said female element of another panel transpires entirely adjacent the mounting plane defined by said girts.

17. A panel assembly including, a span having two vertical support members spaced from one another, top and bottom girts extending between said support members and fixed thereto, a plurality of vertically disposed panels extending between said support members and between said girts, said panels provided with opposite side walls respectively having cooperating mating male and female interlock elements providing a multilateral interlock between adjacent panels following the sequential joining of said interlock elements of succeeding panels, means fastening the opposite ends of said interlocked panels to said top and bottom girts whereby, angular insertion and subsequent rotation of said male element of one panel within said female element of another panel produces a camming action between said elements to urge said male element into said female element.

* * * * *